US010323886B2

(12) United States Patent
Da Silva

(10) Patent No.: US 10,323,886 B2
(45) Date of Patent: Jun. 18, 2019

(54) HEAT EXCHANGER

(71) Applicant: Valeo Systemes Thermiques, Le Mesnil Saint Denis (FR)

(72) Inventor: Patrick Da Silva, Evergnicourt (FR)

(73) Assignee: Valeo Systemes Thermiques, Le Mesnil Saint Denis (FR)

( * ) Notice: Subject to any disclaimer, the term of this patent is extended or adjusted under 35 U.S.C. 154(b) by 270 days.

(21) Appl. No.: 14/431,660

(22) PCT Filed: Sep. 25, 2013

(86) PCT No.: PCT/EP2013/069924

§ 371 (c)(1),
(2) Date: Mar. 26, 2015

(87) PCT Pub. No.: WO2014/048962

PCT Pub. Date: Apr. 3, 2014

(65) Prior Publication Data

US 2015/0241143 A1 Aug. 27, 2015

(30) Foreign Application Priority Data

Sep. 28, 2012 (FR) ..... 12 59163

(51) Int. Cl.
*F28F 9/12* (2006.01)
*F28D 9/00* (2006.01)
(Continued)

(52) U.S. Cl.
CPC ..... *F28F 9/12* (2013.01); *F28D 9/0043* (2013.01); *F28F 3/08* (2013.01);
(Continued)

(58) Field of Classification Search
CPC ..... F28F 9/0219; F28F 9/0224; F28F 2009/029; F28F 9/12; F28F 3/08;
(Continued)

(56) References Cited

U.S. PATENT DOCUMENTS 4,002,433 A * 1/1977 Oser ..... F01N 3/2853 422/176
6,305,465 B1 * 10/2001 Uchikawa ..... F28D 1/0435 165/135
(Continued)

FOREIGN PATENT DOCUMENTS

DE 10024389 A1 * 11/2000 ..... F28D 9/0037
EP 2 450 657 A1 5/2012
(Continued)

OTHER PUBLICATIONS

Schild, FR 2,969,271, Jun. 22, 2012, machine translation.*
(Continued)

*Primary Examiner* — Hung Q Nguyen
*Assistant Examiner* — Mark L. Greene
(74) *Attorney, Agent, or Firm* — Osha Liang LLP

(57) ABSTRACT

The invention relates to a heat exchanger, in particular for a motor vehicle, including a bundle (3) for a heat exchange between a first and second fluid A, L and a housing (5) inside of which said bundle (3) is housed, said exchanger further including at least one collector (7) attached to said housing (5), said collector (7) being configured to guide said first fluid A between said bundle (3) and an inlet or outlet of said exchanger. According to the invention, said collector (7) is configured to form an abutment (9) for positioning the heat exchanger bundle (3) in the housing (5) for attaching said collector (7) to said housing (5).

18 Claims, 2 Drawing Sheets

Figure 1:
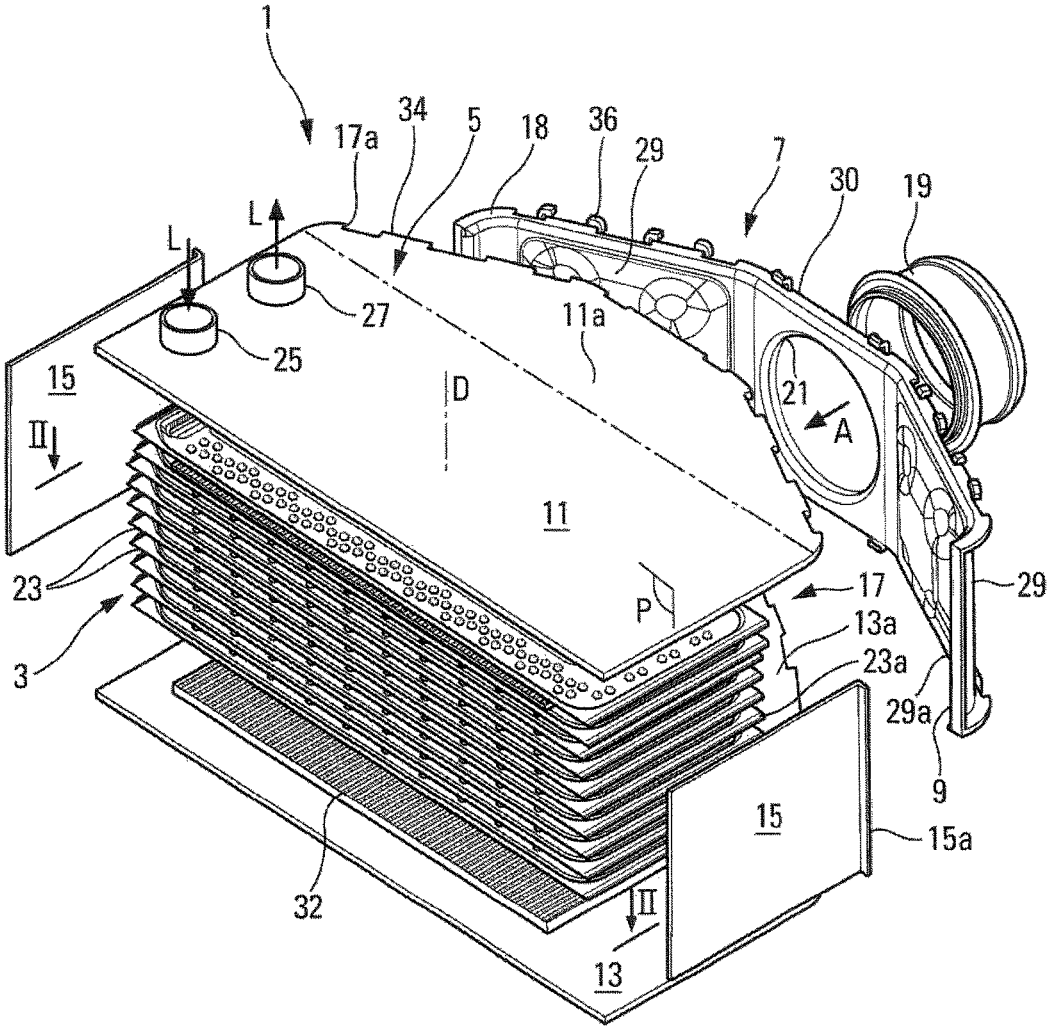

(51) Int. Cl.
*F28F 3/08* (2006.01)
*F28F 9/02* (2006.01)
*F28D 21/00* (2006.01)

(52) U.S. Cl.
CPC ..... *F28D 2021/0082* (2013.01); *F28F 2009/029* (2013.01); *F28F 2280/04* (2013.01)

(58) Field of Classification Search
CPC ..... F28F 9/0246; F28F 2280/04; F28F 2275/08; F28F 2275/085; F28D 7/1653; F28D 7/0041; F28D 9/0043; F28D 2021/0082
See application file for complete search history.

(56) References Cited

U.S. PATENT DOCUMENTS 6,635,227 B1 * 10/2003 Shibata ..... F01N 3/2853 422/177
7,077,190 B2 * 7/2006 Hayashi ..... F01N 5/02 165/148
8,261,816 B2 * 9/2012 Ambros ..... F02B 29/0462 165/158
8,739,857 B2 * 6/2014 Garret ..... F02B 29/0462 165/149
2009/0025916 A1 * 1/2009 Meshenky ..... B21D 13/08 165/151
2011/0168365 A1 * 7/2011 Garret ..... F02B 29/0462 165/148
2011/0240280 A1 * 10/2011 Izumi ..... B23K 1/0012 165/185
2011/0247318 A1 * 10/2011 Kuroyanagi ..... F02M 25/0737 60/278
2013/0192803 A1 * 8/2013 Garret ..... F28D 7/1684 165/151
2013/0213621 A1 * 8/2013 Pierre ..... F28F 3/08 165/166
2014/0109857 A1 * 4/2014 Vallee ..... F02B 29/0462 123/184.21
2014/0246185 A1 * 9/2014 Onetti ..... F28D 9/0043 165/166
2014/0251289 A1 * 9/2014 Vallee ..... F02B 29/0462 123/568.12
2015/0283875 A1 * 10/2015 Vallee ..... F28F 9/00 165/173
2016/0084582 A1 * 3/2016 Maucher ..... F28D 7/12 165/159

FOREIGN PATENT DOCUMENTS

EP 2458312 A1 * 5/2012 ..... F28D 7/1684
FR 2 968 753 A1 6/2012
FR 2969271 A1 * 6/2012 ..... F28D 7/1684
GB 938497 A * 10/1963 ..... F28F 9/165
WO 2009/156365 A1 12/2009
WO WO 2012119834 A1 * 9/2012 ..... F02B 29/0462

OTHER PUBLICATIONS

Uchimura, DE 10024389, Nov. 30, 2000, machine translation.*
International Search Report issued in PCT/EP2013/069924 dated Oct. 18, 2013 (4 pages).

* cited by examiner

HEAT EXCHANGER

The invention relates to a heat exchanger, in particular for a motor vehicle.

In this field, exchangers which are called charge air coolers are known, said exchangers permitting an exchange of heat between the charge air, designed to supply the engine of the vehicle, and a coolant. The exchangers comprise a heat exchange bundle consisting of a stack of plates, defining relative to one another alternate circulation channels for the charge air and for the coolant. It is important for such exchangers to be able to be arranged freely below the hood, in particular in the vicinity of the engine of the vehicle, in contrast to charge air exchangers which are cooled by a flow of external air and which have to be arranged on the front face of the vehicle or at least in the vicinity of an air inlet.

In such exchangers, the bundle is accommodated in a metal housing, collectors which enable the charge air to be guided at the inlet and outlet of the heat exchange bundle being attached thereto.

It has been proposed to attach the collectors to the housing by welding, said collectors being manufactured by casting. This solution, however, is not able to be easily mechanized.

It has also been proposed to braze collectors to the housing at the same time as the brazing of the remainder of the exchanger. In this case, the plates of the bundle have to be positioned in a stack accurately relative to the housing so as to permit a brazed connection which provides a good seal of the parts relative to one another.

To this end, it is possible to use positioning flanges for the plates attached to the housing but this makes the production of the exchanger relatively complex.

The object of the invention is to make improvements and to this end the invention proposes a heat exchanger, in particular for a motor vehicle, comprising a bundle for the exchange of heat between a first and a second fluid, and a housing, said bundle being accommodated in said housing, said exchanger further comprising at least one collector attached to said housing, said collector being configured to guide said first fluid between said bundle and an inlet or outlet of said exchanger, characterized in that said collector is configured to form an abutment for positioning the heat exchange bundle in the housing for assembling said collector to said housing.

Thus, according to the invention, a solution is proposed according to which the collectors permit said heat exchange bundle to be positioned in the housing without having to use added-on elements for positioning the bundle on the housing, which simplifies the structure of the assembly of the exchanger.

Advantageously, said collector comprises a wall which defines a chamber for the passage of the first fluid in the bundle, said wall being configured to form said abutment for positioning the heat exchange bundle in the housing for the assembly of said collector to said housing.

Thus the flow of fluid is prevented from being interrupted upstream and/or downstream of the bundle by the positioning abutments which could be located across the flow of fluid in the housing.

Advantageously, said bundle comprises plates for the circulation of the second fluid, said plates being stacked in a stacking direction in the housing, in particular vertically, and said abutment for positioning the heat exchange bundle in the housing being arranged therein so as to define a transverse position of the heat exchange bundle in the housing relative to the stacking direction of the plates, whilst permitting a freedom of movement in said stacking direction of the plates, when brazing the exchanger.

Advantageously, said positioning abutment consists of at least one deformation of said wall of the collector capable of retaining in position a part, in particular one or more corners of each of the plates, of the heat exchange bundle in the housing.

In particular, said abutment for positioning the heat exchange bundle in the housing comprises at least two said deformations of said wall of the collector, said deformations opposing one another relative to the plates of the heat exchange bundle.

Said deformation of the collector may be a fold in the wall of the collector, produced, for example, by stamping the wall of the collector and thus very simple to implement.

Said fold may be a lateral connecting edge of the collector to the housing, for example said edge forming with the housing a lateral cavity which is arranged so as to retain in position a part, in particular the corner(s), of each of the plates of the heat exchange bundle in the housing.

Advantageously, said lateral connecting edge of the collector is configured to cooperate with a lateral connecting edge of the housing to the collector, preferably along a planar connecting surface which promotes a brazed connection.

In particular, said edges of the collector and the housing are offset relative to one another so as to define a shoulder for positioning said bundle to form said lateral cavity which is arranged so as to retain a part in position, in particular the corner(s) of each of the plates of the heat exchange bundle in the housing.

More particularly, the depth of said edge of the collector is greater than that of said edge of the housing. The difference in depth of said edges constitutes, in particular, said shoulder for retaining in position the corner(s) of the plates of the bundle of the exchanger.

Advantageously, the plates of the heat exchange bundle are identical to one another, for example of rectangular shape, and the stacking thereof defines a parallelepiped, in particular a rectangle.

The heat exchanger may comprise said one collector forming the inlet collector of the exchanger and said further collector forming the outlet collector of the exchanger. Preferably, said collectors oppose one another relative to a central plane of the heat exchange bundle. In particular, said collectors together comprise four deformations of each of the collectors, each capable of retaining in position a corner of the heat exchange bundle in the housing.

The inlet collector and/or the outlet collector are configured so as to be connected, for example, to a conduit or hose for the circulation of the first fluid.

The exchanger may also form an air intake module in which the outlet collector is an air distributor which is configured to be attached to an engine cylinder head so as to distribute the air to the intake pipes of an engine cylinder head.

The invention may have the following complementary features, considered together or separately:

- said housing comprises a lower plate and/or an upper plate, at right angles to the stacking direction of the plates of the bundle, said lower and/or upper plates comprising an extension forming the wall of the collector,
- the wall of the collector comprising said positioning abutment is a lateral wall connected to said upper and/or lower plates of the housing, in particular in the region of said extensions, said bundle is attached to said collector by at least one of its corners.

Said exchanger is made, for example, of aluminum and/or aluminum alloy. It is possible to braze the collector to said housing in a single operation, said brazing advantageously being performed in a single operation or a single step when the heat exchanger is brazed, said exchanger having been previously assembled so that said bundle is positioned in said housing by said collector(s) using said positioning abutment. It could also be considered that the invention also relates to such a method for manufacturing a heat exchanger.

Figure 2:
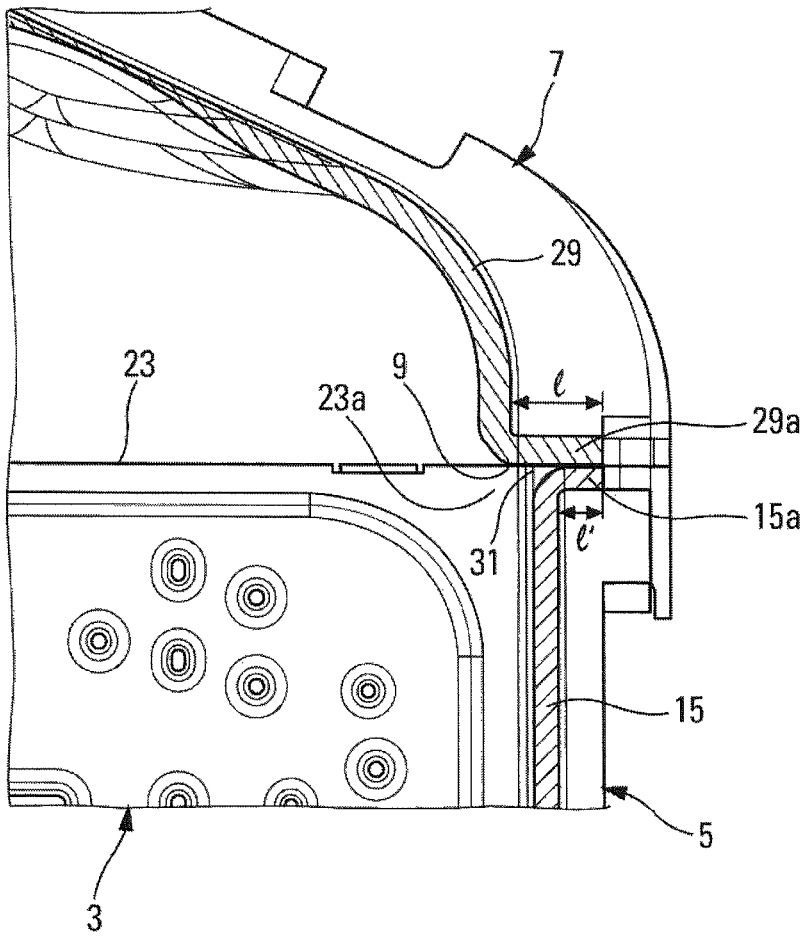

Further features and advantages of the invention will appear more clearly from reading the following description of embodiments of the invention provided by way of illustrative example, with reference to the accompanying drawings, in which:

FIG. 1 is a partial exploded perspective view illustrating an embodiment of a heat exchanger according to the invention, and FIG. 2 is cross-sectional view along the line II-II of a part of the heat exchanger of FIG. 1.

Identical reference numerals are used to denote identical or similar elements.

As illustrated in FIG. 1, the invention relates to a heat exchanger 1, in particular for a motor vehicle, comprising a bundle 3 for the exchange of heat between a first fluid A (along the arrow) and a second fluid L (along the arrow) and a housing 5, said bundle 3 being accommodated therein. Said exchanger 1 further comprises at least one collector 7 attached to said housing 5, for example an air inlet A collector 7 fixed to said housing as illustrated in the present case and an air outlet collector (not shown) which may be symmetrical to the inlet collector 7 relative to a central plane P of the bundle 3 or the heat exchanger. Said exchanger is produced, for example, in aluminum and/or aluminum alloy.

Said first fluid A may be charge air of the engine of the vehicle. Said second fluid L may be a coolant.

The housing 5 has in this case two parallel, substantially rectangular upper 11 and lower 13 faces, provided with a substantially trapezoidal extension 11 *a*, 13 *a*. The extensions 11 *a* and 13 *a* of said upper and lower faces beyond the section or projection of the bundle 3 respectively constitute the upper and lower faces of the collector 7. The housing further comprises two rectangular lateral walls 15, opposing one another and connecting said upper 11 and lower 13 faces. It is noteworthy that as a variant (not shown) one wall thereof may constitute a collecting plate for the bundle connected to two respective inlet and outlet lateral collecting tanks for the second fluid. The housing thus comprises two faces which remain open, said faces opposing one another and called the first and second free faces 17.

The inlet collector 7 for the first fluid is connected to the first free face 17 of the housing by an edge 17*a* of said housing, in this case said extensions 11*a* and 13*a* of said upper 11 and lower 13 faces are applied against a corresponding flat edge 18 of a cover 30 of the collector. The housing 5 is connected to the outlet collector (not shown) in the region of its second free face. Thus the first fluid A passes through the heat exchange bundle 3 guided by the housing 5, on both sides from the inlet collector 7 to the outlet collector, entering and leaving the exchanger via connecting tubes 19 to conduits or hoses for the circulation of fluid, by means of respective inlet and outlet orifices 21.

Each of the upper and lower faces 11, 13, and lateral wall 15 of the housing consists in this case of a plate, said plates being attached to one another by their edge, in particular by brazing, to form said housing.

Circuits for the circulation of the first fluid A are provided in the heat exchange bundle 3 via agitators 32, only the agitators of an upper and lower part of the bundle having been shown. More specifically, in the example, the bundle 3 is formed of parallel plates 23 stacked in a stacking direction D, said plates permitting the circulation of the first and the second fluids A, L so as to ensure an exchange of heat between said fluids.

The plates 23 are grouped into pairs and together define a circuit for the circulation of the second fluid L. An upper plate and a lower plate of one and the same pair of plates 23 complement one another to form a conduit for the circulation of the second fluid L. The plates 23 of one and the same pair comprise two opposing projections (not shown) permitting the second fluid L to pass into the conduit formed by said pair of plates, said projections of one pair of plates being connected to the projections of the pairs of adjacent plates. Said housing comprises an inlet conduit 25 and an outlet conduit 27 for the second fluid L, located on one side of the housing, said conduit inlet 25 and outlet conduit 27 conduits discharging opposite cavities for the circulation of the second fluid L formed by said projections. The circuits for the circulation of the first fluid A are defined by the plates 23 of two pairs of adjacent plates.

The plates 23 here have the general shape of an elongated rectangle having a length slightly less than that of the upper and lower faces 11, 13 of the housing and having a width equal to that of the lateral walls 15 of the housing (see also FIG. 2). The stacking of the plates 23 forms a rectangular parallelepiped.

Said bundle 3 is attached to the assembly consisting of the housing 5 and collectors 7, in particular, by brazing. More specifically, each of the covers 30 of the collectors 7 comprises a lateral wall 29 connected to the lateral walls 15 of the housing along a lateral edge 29*a* of the wall 29 of the collector joining an edge 15*a* of the wall 15 of the housing.

As will appear more clearly from FIG. 2, said edges of the collector and housing 29 *a*, 15 *a* form a shoulder or a lateral cavity 31 shaped as a right angle or corner, the apex thereof being defined by a line parallel to the stacking direction of the plates 23. In this manner, an abutment 9 is defined, said abutment being capable of retaining in position in the housing, with a small amount of clearance, one or more corners 23 *a* of each of the stacked plates 23 of the heat exchange bundle.

The depth I of said edge 29*a* of the collector is greater than the depth I' of said edge 15*a* of the housing. The difference in depth I, I' of said edges 29*a*, 15*a* constitutes said shoulder or cavity 31 for retaining in position the corner(s) 23*a* of each of the stacked plates 23. Said edges 29*a*, 15*a* are produced here by stamping the walls 29, 15 of the collector and the housing, which as already mentioned are made of metal, for example, in particular aluminum and/or aluminum alloy.

Said lateral edge 29 *a* of the wall of the collector cooperates with the lateral edge 15 *a* of the housing due to a connection produced along a flat connecting surface, surface to surface. In total four shoulders or cavities 31 are formed, two per collector, to receive the four corners of each of the plates and by extension the four edges of the rectangular parallelepiped consisting of the stack of plates.

As mentioned above, each of the collectors 7 may be brazed to said housing 5, at the same time as the brazing of the housing 5 and the bundle 3, in particular the different stacked plates 23 which constitute said bundle. Thus, it is possible to braze said housing 5, bundle 3 and collectors simultaneously in one operation.

Generally, according to the invention, the collector 7 is configured so as to form an abutment 9 for positioning the heat exchange bundle 3 on the housing 5, for assembling said collector to said housing. By this is understood that the assembly of the collector on the housing positions the bundle in said housing. In the case of a manufacture of the exchanger by brazing, such a positioning takes place before brazing the parts together. This has the purpose of ensuring the quality of the brazing whilst providing the prior positioning of the parts. In particular, such an assembly takes place before the exchanger is moved into a brazing furnace.

Such an assembly before brazing may be obtained by crimping the walls 29, 15 of the collector and the housing, in this case using the teeth 34 of the housing cooperating with the clips 36 of the collector (FIG. 1).

It is noteworthy that, due to the cavities or shoulders 31, the plates 23 are positioned in a stack accurately relative to the housing (transversely to the vertical stacking direction of the plates, in vertical alignment) so as to be maintained horizontally in the housing whilst permitting a freedom of movement in the vertical direction for connecting the plates to one another by brazing.

It is also noteworthy that the abutment formed by the invention does not occupy, or only occupies to a small extent, the surface for the passage of the first fluid through the bundle. In this manner, an interruption to the flow of said first fluid and the reduction of the heat exchange surfaces are prevented.

Moreover, this design of the collector formed with wall extensions of the housing and a single cover 30 facilitates the punching of said cover 30 whilst permitting, in a single forming operation, to obtain simultaneously said deformations for positioning the bundle in the housing and the connecting edges for brazing to the housing.

According to a variant, not illustrated, the heat exchanger may also form an air intake module in which the outlet collector is an air distributor which is configured so as to be attached to an engine cylinder head in order to distribute the air to the inlet pipes of the cylinder head. The first fluid then circulates through the inlet collector, the exchanger and the air distributor.

The various features, described above, of the different elements of the exchanger may be combined together or provided separately from one another, if appropriate.

The invention claimed is:

1. A heat exchanger for a motor vehicle, comprising:

a bundle for the exchange of heat between a first fluid and a second fluid and a housing, the bundle being accommodated inside the housing and contacting two lateral walls of the housing; and at least one collector attached to the housing via a two-plate flange joint formed between a flange of the at least one collector and a flange of the two lateral walls of the housing, the at least one collector being configured to guide said first fluid between the bundle and an inlet or an outlet of the heat exchanger, wherein the at least one collector is configured to form an abutment for positioning the bundle in the housing and for assembling the at least one collector to the housing, wherein the bundle comprises a stack of plates, each plate of the stack of plates having a rectangular shape and comprising four corners, wherein the abutment directly contacts a transverse side of each of the plates in the stack of plates at at least one of the four corners of each of the plates in the stack of plates and retains the stack of plates transversely, and wherein the abutment comprises a portion of the flange of the at least one collector.

2. The heat exchanger as claimed in claim 1, wherein the bundle comprises the stack of plates for the circulation of the second fluid, the stack of plates being stacked in a stacking direction in the housing, and the abutment for positioning the bundle in the housing being arranged therein so as to define a transverse positioning of the bundle in the housing relative to the stacking direction of the plates whilst permitting a freedom of movement of the plates in the stacking direction.

3. The heat exchanger as claimed in claim 1, wherein the at least one collector comprises a wall which defines a chamber for the passage of the first fluid in the bundle, the wall being configured to form the abutment for positioning the bundle in the housing for assembling the collector to the housing.

4. The heat exchanger as claimed in claim 3, wherein the abutment for positioning the bundle in the housing consists of at least one deformation of the wall of the collector capable of retaining in position a part of the bundle in the housing.

5. The heat exchanger as claimed in claim 4, wherein at least a second abutment for positioning the bundle in the housing is formed by at least a second deformation of the wall of the at least one collector, the abutments opposing one another relative to the bundle.

6. The heat exchanger as claimed in claim 4, wherein the at least one deformation of the at least one collector is a fold in the wall of the at least one collector.

7. The heat exchanger as claimed in claim 6, wherein the fold is made from stamping the wall of the at least one collector.

8. The heat exchanger as claimed in claim 6, wherein the flange of the at least one collector comprises the fold.

9. The heat exchanger as claimed in claim 8, wherein the flange of the at least one collector and the flange of the two lateral walls of the housing are offset relative to one another so as to define a shoulder for positioning said bundle.

10. The heat exchanger as claimed in claim 1, wherein the housing comprises a lower plate and/or an upper plate, at right angles to a stacking direction of the stack of plates of the bundle, said lower plate and/or said upper plate comprising an extension forming a wall of the at least one collector.

11. The heat exchanger as claimed in claim 10, wherein another wall of the at least one collector comprises the abutment and, wherein the two lateral walls are connected to the upper plate and/or the lower plate of the housing.

12. The heat exchanger as claimed in claim 1, comprising one of the at least one collector attached to the housing and configured to guide said first fluid between the bundle and the inlet of the heat exchanger, and a second collector of the at least one collector attached to the housing and configured to guide said first fluid between the bundle and the outlet of the heat exchanger.

13. The heat exchanger as claimed in claim 12, wherein the one of the at least one collector and the second collector of the at least one collector together comprise four deformations, each capable of retaining in position respective ones of the four corners of each of the plates in the housing.

14. The heat exchanger as claimed in claim 12, configured as an air intake module in which the second collector is an air distributor which is configured to be attached to an engine cylinder head so as to distribute air to intake pipes of the engine cylinder head.

15. The heat exchanger of claim 1, wherein the housing comprises one or more teeth which extend directly from an edge of the housing and the at least one collector comprises one or more clips which extend at a right angle to an edge of the at least one collector, and wherein the teeth are configured to extend into the clips.

16. The heat exchanger of claim 15, wherein the one or more clips comprise two clips proximate a central portion of a top surface of the at least one collector, such that the two clips face in opposite directions.

17. The heat exchanger of claim 15, wherein one or more of the one or more clips extend in a direction perpendicular to a plane of a wall of the at least one collector towards a center of the at least one collector.

18. The heat exchanger of claim 1, wherein the at least one collector comprises a connecting tube which engages with the at least one collector and which extends from the at least one collector perpendicular to a stacking direction of the bundle.

* * * * *